United States Patent [19]

Slimp, Jr.

[11] 4,200,292

[45] Apr. 29, 1980

[54] TILTABLE BOARD GAME APPARATUS

[76] Inventor: Jack B. Slimp, Jr., 8700 Artillery Rd., Manassas, Va. 22110

[21] Appl. No.: 833,284

[22] Filed: Sep. 14, 1977

[51] Int. Cl.[2] ..... A63F 3/02

[52] U.S. Cl. ..... 273/258; 273/1 R

[58] Field of Search ..... 273/1 R, 1 E, 1 M, 282, 273/258, 110

[56] References Cited

U.S. PATENT DOCUMENTS

| | | | |
|---|---|---|---|
| 1,441,386 | 1/1923 | Truskoski | 273/282 |
| 2,187,808 | 1/1940 | Parker | 273/258 |
| 2,551,318 | 5/1951 | Drew | 273/282 X |
| 3,188,089 | 6/1965 | Odell et al. | 273/258 |
| 3,567,221 | 3/1971 | Stults | 273/1 R |
| 3,618,949 | 11/1971 | McLain et al. | 273/110 |
| 3,730,527 | 5/1973 | Nelson | 273/258 |

*Primary Examiner*—Paul E. Shapiro

*Attorney, Agent, or Firm*—Mason, Mason and Albright

[57] ABSTRACT

An amusement game that has a flat board with a central pair of axes providing a fulcrum and spaces on either side of the axes. Playing pieces of different weights are received in respective openings in the spaces and the fulcrum is elevated to allow tilting of the board in either direction when the pieces are unevenly distributed. Each side has at least one marked zone of spaces, which zone is preferably T-shaped.

10 Claims, 3 Drawing Figures

TILTABLE BOARD GAME APPARATUS

BACKGROUND OF THE INVENTION

This invention relates to game apparatus for a game which is controlled by the skill of the players. More particularly, it relates to a game device which includes a board which can be tilted by the movement and removal of pieces on the board.

Games which involve boards which tilt due to the movement of pieces along the game board have long been known. The following U.S. patents have issued on tilting games of one type or another: Nos.

| | |
|---|---|
| 479,683 | Truman |
| 562,264 | Wilcox |
| 596,089 | Patterson |
| 797,105 | Graves |
| 1,201,974 | Kohler |
| 1,215,033 | King |
| 2,458,306 | Schneider |
| 3,188,089 | Odell et al |
| 3,402,929 | Glass et al |
| 3,471,147 | Glass et al |
| 3,675,920 | Gorman |
| 3,764,134 | Reinertsen |

Despite the rather large relative number of game devices which have been introduced which involve the maintaining of the equilibrium of the game board or causing same to tilt as part of the game play, such games have not achieved general popularity. Nevertheless, inasmuch as the introduction of the equilibrium of the game board into the game play produces an interesting further parameter into the game, it is believed that with the proper combination of game apparatus and rules, a game may be produced which will have broader acceptance by the general public than comparable games heretofore of this type which have been known publicly.

SUMMARY OF THE INVENTION

The primary purpose and object of the present invention is to provide a novel game apparatus which utilizes the equilibrium (or lack of equilibrium) of the game board as part of the game play wherein the competitive effort of the players depends entirely on their mental skill. Essentially the game is directed to a rectangular game board which is caused to tilt by the movement of pieces positioned by openings provided in the game board. The various playing pieces have different weights—three or four different weighted pieces being utilized in the present invention. The game play involves the alternate moving of the weighted pieces on the board by the players until the board is caused to tilt one way or the other sufficiently to touch the underlying surface, at which time a further weighted piece, several of which are provided along the outboard extremeties of the playing board on each side, is removed to restore the board to equilibrium. The object of the game is to fill an outlined portion of the board with playing pieces on the side opposite each player. An important aspect of the invention lies in the provision of two parallel axes which are parallel to and on either side of an axis which passes through the center of gravity of the board and is perpendicular to the longer sides of same, such parallel axes both being positioned relative to the center of gravity of the board so that when the board is no longer in equilibrium due to the movement of weighted pieces, it will not balance in a non-horizontal position above the surface on which the board is supported but rather continues to tilt until the board touches such surface.

DESCRIPTION OF THE PREFERRED EMBODIMENTS

Figure 1:
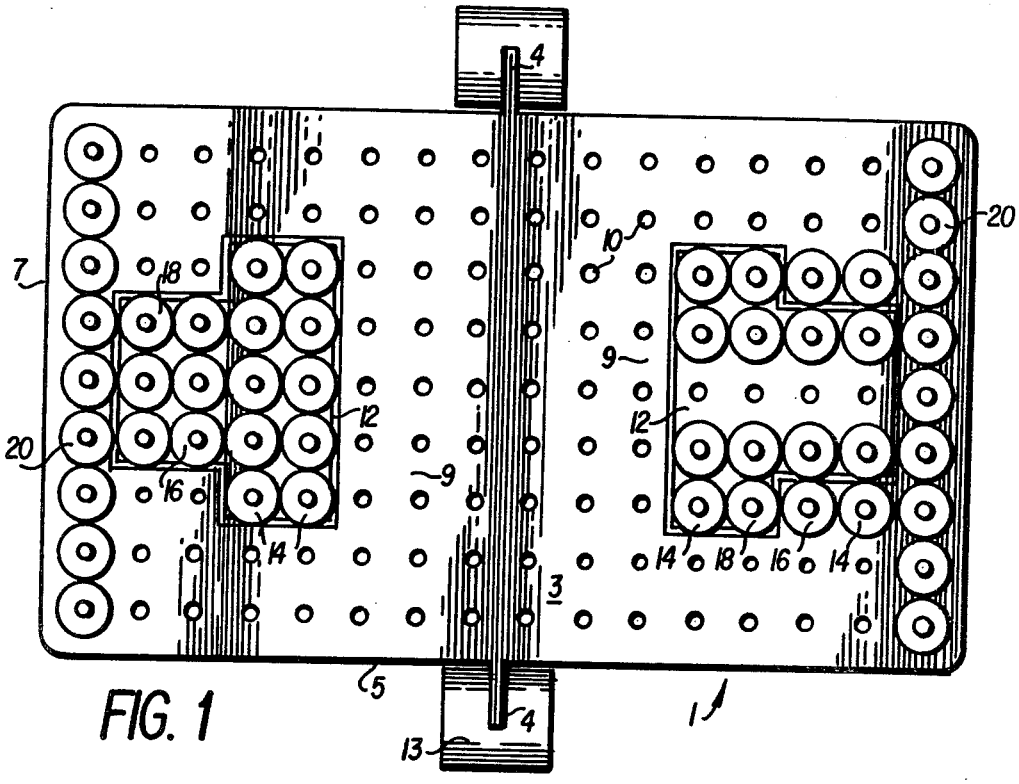
FIG. 1 is a plan view of the game board and pieces.
Figure 2:
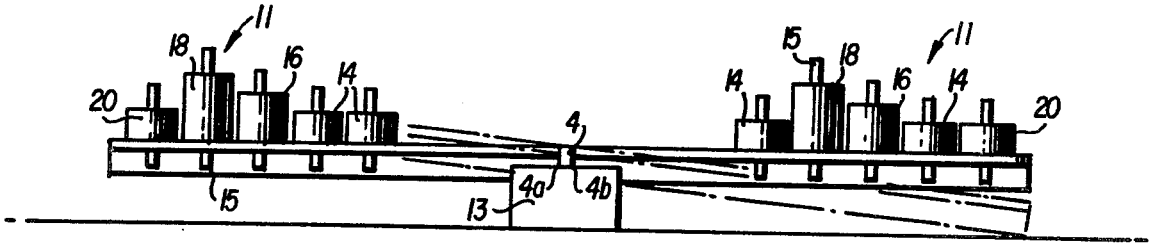
FIG. 2 is a side elevation of the assembly.
Figure 3:
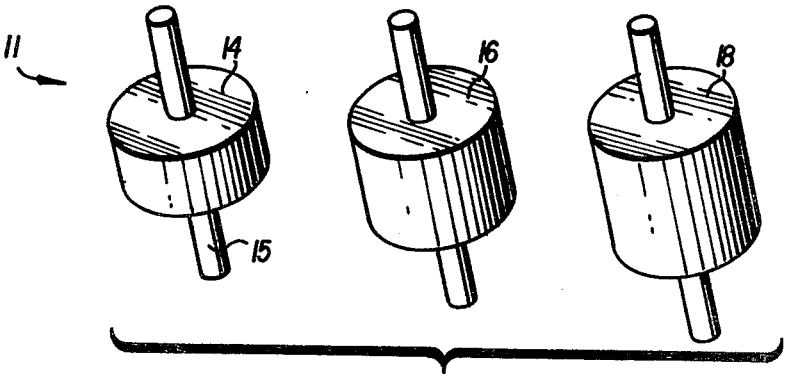
FIG. 3 is a perspective view of the different sized playing pieces.

In FIG. 1, the assembly 1 in its entirety includes a board 3 which is of generally rectangular configuration as seen in plan and has a pair of oppositely extending projections 4. Projections 4 are rectangular in cross-section and extend from longer sides 5 of board 3. Projections 4 define a pair of parallel adjacent fulcrums or central axes **4*a* and 4*b* of the board which divide board 3 into two playing sides and the shorter sides 7 afford bases for the sides. Axes 4*a* and 4*b* comprise the lower right and left corners of projections 4, respectively, as seen in FIG. 2**.

Each side of board 3 has an equal number of spaces 9 that can be marked in squares or be plain as shown, but in either case, spaces 9 are defined by respective apertures 10 in the centers thereof. Also, each side has a marked zone 12 which in the drawings is T-shaped with the stem of the zone being one row of spaces 9 removed from the shorter side 7. Zones 12 afford safety zones in the device now described. The top or inboard portion of the zone is five spaces across and two spaces deep. The stem portion of zone 12 is three spaces across and two spaces deep.

With the above arrangement, board 3 has one hundred and forty-four spaces arranged nine across and sixteen lengthwise. Each space 9 can be occupied by a playing piece designated generally by reference numeral 11 and preferably there are three categories of playing pieces having different sizes and weights; namely, 14, 16 and 18. Each playing piece has a peg at two opposite sides which can be slideably and relatively closely received and retained, so there is no lateral play, in any of apertures 10 of the spaces. Each playing individual or partnership is provided with a row of nine point pieces 20 which are not normally moved along the length of board 3, but remain in the base row of each side 7 until removed from the board.

Playing pieces 11 for each side can be colored or otherwise identified differently from one another and include pieces 14 of small size and light weight, pieces 16 of medium size and weight and pieces 18 that are heavy and large sized pieces. Preferably pieces 11 are stone or wood or composed of a metal such as aluminum or brass. However, solid plastic has been found operable and, in practice, is the most economical.

The game is ready for playing when board is level, balanced on projections 4 resting on blocks 13 positioned an inch or so above a table or other support surface.

Point pieces 20 are placed in the last row along each side 7, nine pieces in each row. If there are two players, each player has three large pieces 18, three medium pieces 16, and ten small pieces 14. If there are three players, one player has three large pieces 18, three medium pieces 16, and ten small pieces 14; each of the other two players (partners against the one) has two large pieces 18, two medium pieces 16, and four small pieces 14. Finally, if there are four players, each player has two large pieces 18, two medium pieces 16, and four small pieces 14. The playing pieces 11 of each player/-partner can be initially set up at the safety zone closest to each as indicated below.

Two players: Each player arranges all of his playing pieces 11 in his safety zone 12 so that three pieces 18 are in the bottom row, three pieces 16 in the row above, and ten pieces 14 in the two upper rows of zone 12.

Three players: The player against the partnership arranges his pieces 11 the same as for a two-player game while each of the partners arranges his pieces 11 next to his partner's so that the center column of the zone 12 is vacant and some pieces 11 are set up outside the zone. One partner sets up on the left of the center column and the other partner sets up on the right; half of the playing pieces 11 placed in the bottom two rows will be outside zone 12. Each partner arranges his pieces 11 so that two small pieces 14 are in the bottom row, two medium pieces 16 in the row above, two large pieces 18 in the next row, and two small pieces 14 in the top row.

Four players: Each partnership sets up in the same manner as the partnership for a three-player game.

The players move their playing pieces 11 generally towards the opposite zone 12 in order to earn points by tilting down the opponent's side of the board. Pieces are maneuvered to block, jump, capture, and sacrifice while players strive for the ultimate objective of ending the game with the most points.

Players start with their pieces 11 at or in safety zone 12 on their own side of board 3 and the pieces 11 are moved towards the opponent's safety zone 12 one space at a time while maneuvering to gain advantage. A player earns points with a move which tilts down the opponent's side of board 3 so that the distant side 7 rests upon the table. Projections 4 are dimensioned to have a certain width between axes **4*a* and 4*b* which allows the raised board 3 to be tilted only when a particular leverage differential is exceeded. This width can be varied or biased by providing rectangular sleeves over projections 4 as would occur to one understanding the game. Points are collected, when earned, by removing weighted point pieces 20 from the downed end of opposite end of the board; just enough point pieces being removed so that the downed end 7 of the board lifts back off the table. The game is typically ended when one player has moved all uncaptured game pieces from his zone 12 into his opponent's zone 12. The winner is the player with the most points; or, if the players have equal points, the winner is the player who ended the game. During movement of a game piece on the game board, the game board may be held by the player to avoid tilting. However, once the game piece has been placed in its new position, the game board must be released by the player so that it can be determined whether the board will remain in equilibrium or will tilt so that one outboard end of the board reaches the plane comprised of the surface on which the blocks 13** are received.

There are two basic strategies. One strategy is to sacrifice capturable pieces 15 and 18 while moving the remaining playing pieces 11 quickly into the opponent's safety zone 12. Timely sacrifice of capturable pieces 16 and 18 removes weight from a player's own side of the board, and the resulting smaller number of pieces may provide increased mobility. Another strategy is to prevent, insofar as practicable, the capture of all pieces so that their weight may be employed in tilting down the opponent's side of the board while maneuvering into opponent's safety zone 12. The blocking of opponent's pieces, especially the large pieces 18, may be desirable under either strategy.

The rules are that unless jumping, a game piece 11 can move only one space 9 at a time in any direction; i.e. forward, backward, sideways, or diagonally. A piece 11 may jump any adjacent piece 11 in any direction if the space 9 beyond the adjacent piece is vacant. If the jumping piece 11 lands on a space adjacent to another piece, it may continue jumping in the same turn until no more jumps are possible or desired. It is the option of the player to take any jumps available. All pieces 11 can jump all other game pieces except that the large or heavy pieces 18 cannot jump any of the opponent's pieces 11.

Also, pieces 11 cannot move into either end row of the board since those rows are only for point pieces 20. No piece 11 may jump the same capturable opponent's piece 11 more than once; i.e., during a circular multiple jump move. Large and medium pieces 18 and 16 are capturable if they are not inside a safety zone 11. Capturable pieces are captured and removed from the board if jumped by an opponent's piece 11. Captured game pieces are worth no points, but they can afford a tactical advantage. Captured pieces are removed before determining if the board tilts and points are earned.

A player can earn and acquire only his own point pieces and a player accomplishes a tilt-down and earns one or more points when his move tilts down his opponent's side of board 3 so that the distant end of the board rests upon the table; a player incurs a tilt-back if his move similarly tilts down his own end of the board, in which case his opponent earns the point or points. The number of earned points is determined by removing the minimum number of point pieces 20 from the downed end of the board to allow it to lift off the table. Those point pieces removed from the board become "acquired" point pieces. If a player accomplishes a tilt-down after he has acquired all of his point pieces, then his opponent must replace enough of his acquired point pieces (and thus relinquish those earned points) to lift the downed end off the table. In those situations where the opponent has no acquired points to relinquish, he loses the game to the player with all the points.

If a player keeps game pieces in his safety zone 12 so that his opponent cannot move in all of his uncaptured game pieces, the opponent ends and wins the game when that zone is completely filled with the pieces of both players.

The above rules for two players apply to three and four players except for a few differences. Where rules for two players refer to a player or opponent, the same can also apply to a partnership. In a three-player game, one partnership plays against an individual. In a four-player game, one partnership plays against another partnership. Since turns alternate from one side of the board to the other, a move is made by one partner followed with a move by the other partner. For three players, the partnership makes the first move because the board is balanced against the partnership in the set up arrangements. For instance, the first move is made by partner A, the second move by the individual (non partner), the third by partner B, the fourth by the individual, the fifth by partner A, etc. For four players, where players A and B form one partnership and players C and D form the other, the turns are taken in the sequence of A, C, B, and D. Each player moves only his own pieces during his turn. Partners may discuss tactics and moves, but such discussions must be audible to all other players.

For a partnership to end the game, both partners must move all their uncaptured game pieces into the opponent's safety zone 12. All pieces 11 of the same partnership may jump each other without capturing each other. A special rule for the three-player game is that the large pieces 18 of the partnership are allowed to jump any of the opponent's pieces 11.

It will be noted from FIG. 2 that once board 3 has commenced to tilt, as shown by dot-dash basis, about an axis (**4*b* in this case) the moment on the down side is increased so that the board will not balance. Rather, it will continue to tilt until reaching the table surface. This desired instability of the board is achieved by locating the axes 4*a* and 4*b* lower than the center of gravity of board 3 and, of course, spaced equal distances on both sides of a horizontal line passing through such center of gravity which is perpendicular to the longer sides 5**.

Although I have described the preferred embodiment of my invention, it is to be understood that it is capable of other adaptations and modifications within the scope of the appended claims.

Having thus described my invention, what I claim as new and desire to secure by letters patent of the United States is:

1. An amusement device comprising a flat, generally rectangular board that has a central balancing axis which divides the board into two opposite sides, a fulcrum said board being tiltable with respect to said fulcrum from a balanced neutral, substantially horizontal position to a tilted position in which one side is elevated above the other side, a plurality of pieces in categories of different weights and said sides having spaces that receive said playing pieces, said pieces being arranged in sets and each set having categories of playing pieces of different weights and a plurality of point pieces, each side having at least one marked zone of spaces and the number of spaces on each side being equal, said board being tilted about said axis in response to an uneven distribution of pieces on either side relative to the opposite side.

2. The device of claim 1, wherein each space is apertured in the center thereof and a piece is retainable in the aperture of said space.

3. The device of claim 2, wherein each piece comprises a body with peg means that fits in said aperture.

4. The device of claim 1, wherein the apertures are spaced apart at equal distances from one another.

5. The device of claim 1, wherein said zone is T-shaped and the top of said zone is closer to said axis than the bottom thereof.

6. The device of claim 1, wherein there are two sets of playing pieces, each side having sixteen playing pieces and nine point pieces.

7. The device of claim 6, wherein said board has one hundred and forty-four spaces.

8. A game device which comprises in combination a substantially flat game board comprising two symmetrical portions with an axis passing through the board's center of gravity comprising a boundary between said portions, a projection from said board extending therefrom, said projection defining a pair of parallel axes spaced below said board which are parallel to and spaced an equal a distance on each side of said first mentioned axis, a surface receiving said pair of axes, said board being tiltable in one direction about one of said pair of axes and in the other direction about the other of said pair of axes, movable playing pieces of selected different weights being provided for said board, said board being provided with a plurality of spaces for receiving said playing pieces, point pieces provided for placement on or removal from said board for restoring said board to equilibrium when the movement of said playing pieces have caused said board to tilt.

9. The game device of claim 8 wherein each said space is apertured in the center thereof and each said piece includes projection means which is retainable in each said aperture.

10. The device of claim 8, wherein said point pieces are received in spaces positioned at opposite outboard ends of said board away from said axes.

* * * * *